US005326088A

United States Patent [19]

Newsome

[11] Patent Number: 5,326,088

[45] Date of Patent: Jul. 5, 1994

[54] APPARATUS FOR FEEDING SIGNATURES TO A ROTARY DRUM WITH ANGULARLY SPACED GRIPPERS

[76] Inventor: John R. Newsome, c/o SIM Products, R.R. #1, Box 58A, Moccasin Rd., Shumway, Ill. 62461

[21] Appl. No.: 935,909

[22] Filed: Aug. 27, 1992

[51] Int. Cl.[5] ..... B65H 5/22

[52] U.S. Cl. ..... 271/3.1; 271/4

[58] Field of Search ..... 271/3.1, 4, 6, 7, 277, 271/69; 270/54, 55, 795.8, 798.3, 788.8, 788.9, 794.8, 797.6, 797.8

[56] References Cited

U.S. PATENT DOCUMENTS

| | | | |
|---|---|---|---|
| 4,436,297 | 3/1984 | Chandhoke | 271/150 |
| 4,989,850 | 2/1991 | Weller | 270/54 |
| 4,993,702 | 2/1991 | Jackson | 271/277 |
| 5,088,711 | 2/1992 | Newsome | 270/54 |

FOREIGN PATENT DOCUMENTS

| | | | |
|---|---|---|---|
| 3926607 | 3/1990 | Fed. Rep. of Germany | 271/277 |

OTHER PUBLICATIONS

Pages 42, 45, 47 and 50 of an Operating Manual (Publication date unknown) published by Harris Graphics. Drawing, date unknow, by World Color Press, Inc. and designated "855 Pocket".

*Primary Examiner*—David H. Bollinger

*Attorney, Agent, or Firm*—Leydig, Voit & Mayer

[57] ABSTRACT

A rotary drum with angularly spaced grippers delivers magazine signatures to the collating conveyor of a saddle stitch binding machine. The signatures are supplied to the drum in the form of a running shingle with successive leading signatures being pulled out of the shingle by successive grippers as the latter rotate through a transfer station.

3 Claims, 3 Drawing Sheets

APPARATUS FOR FEEDING SIGNATURES TO A ROTARY DRUM WITH ANGULARLY SPACED GRIPPERS

BACKGROUND OF THE INVENTION

This invention relates to an apparatus for transporting paper signatures or the like to a processing line such as the collating conveyor of a binding machine. More specifically, the invention relates to apparatus for feeding signatures to the angularly spaced grippers of a rotary drum which, in turn, transfers the signatures to the collating conveyor of a so-called saddle stitch binding machine.

A rotary drum of the foregoing type is well known. The drum is rotated continuously and at high speeds and carries a pair of grippers adapted to rotate successively through a transfer station. At the transfer station, each open gripper receives the leading edge portion of a signature presented to the gripper and then closes upon the signature. With continued rotation of the drum, the gripper moves the signature toward the collating conveyor and then releases the signature for further handling by the conveyor.

Heretofore, apparatus for feeding a rotary drum of the foregoing type has consisted of a hopper for holding a queue of signatures on edge, along with conveyor means for feeding the signatures one-by-one and in spaced apart relation from the queue to the grippers of the drum. The conveyor means must be operated at a high speed in order to effect a high transfer rate. Operating the conveyor means at high speeds results in rapid wear and, in addition, extreme precision is required to insure that one signature, and one signature only, is pulled from the queue at a time and to insure that the signature is properly placed in the gripper.

In apparatus of the above type, the queue in the hopper is formed either by manually loading the signatures into the hopper or by automatically loading the hopper. In manually loaded systems, high skill and dexterity are required to establish and replenish a good queue which presents itself for handling in a precise fashion by the conveyor means. Moreover, one person is required to replenish the queues of several lines and thus is required to work with speed as well as accuracy. While automatically loaded systems are less labor intensive, presently available systems require considerable set up time and, in addition, the queues established by such systems are not as precise and reliable as those established by a skilled worker.

SUMMARY OF THE INVENTION

The general aim of the present invention is to provide new and improved apparatus for feeding signatures to the grippers of a rotary drum, the apparatus being simpler to operate and more reliable and trouble-free than prior apparatus of the same general type.

A more detailed object of the invention is to achieve the foregoing by providing apparatus in which the signatures are fed to the rotary drum as a running shingle and in which successive grippers of the drum pull successive leading signatures directly from the shingle for further transfer by the drum. As a result of the signatures being transferred to the grippers of the drum as a running shingle, the speed of the conveyor means for advancing the signatures may be reduced significantly to reduce wear and tear and, in addition, to enable a rather wide margin of error in the setback of the signatures in the shingle while still reliably feeding signatures to the grippers.

A further object of the invention is to provide apparatus in which the running shingle is established by stripping signatures from a hopper which is automatically and precisely replenished with signatures.

These and other objects and advantages of the invention will become more apparent from the following detailed description when taken in conjunction with the accompanying drawings.

DETAILED DESCRIPTION OF THE PREFERRED EMBODIMENT

Figure 1:
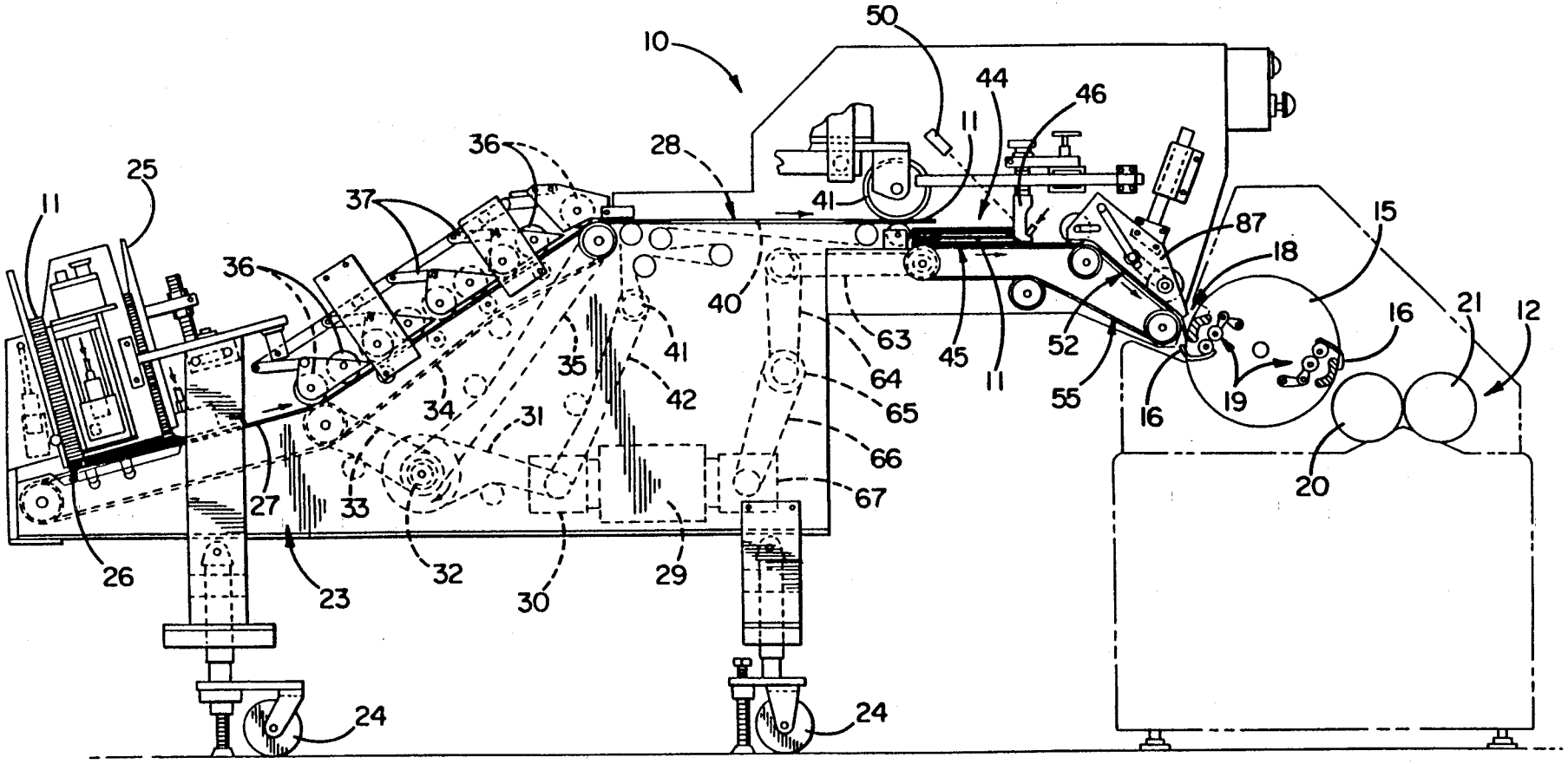
FIG. 1 is a side elevational view of new and improved signature handling apparatus incorporating the unique features of the present invention, certain parts being broken away and shown in section.

For purposes of illustration, the invention has been shown in the drawings as embodied in apparatus 10 for transporting paper signatures 11 to the collating conveyor 12 of a binding machine. Conventionally, the pages of magazines are supplied from the printing operation to the binding operation in the form of several groups of signatures, a signature being a multiple sheet folded assembly having a spine defined by the folded margin. At the binding operation, the groups of signatures are collated and bound to form the magazine.

The collating conveyor 12 shown diagrammatically in FIG. 1 is used in conjunction with a so-called saddle stitch binding operation. Signatures 11 are transferred to the conveyor by a power-rotated drum 15 of conventional and well known construction. Drums similar to the drum 15 are widely used by Harris Graphics. Such a drum is rotated continuously in a counterclockwise direction about a horizontal axis and carries a pair of diametrically spaced grippers 16. Each gripper is in an open position as the gripper approaches a transfer station 18 located approximately at a nine o'clock position relative to the drum. As the gripper moves into the transfer station, a signature 11 is fed into the gripper. Mechanism 19 carried by the drum then closes the gripper on the leading edge portion of the signature so that the signature advances with the drum as the gripper rotates out of the transfer station. When the gripper approaches the three o'clock position, it opens and releases the signature to a transfer drum 20. After being processed by an opener drum 21, the signature is advanced by the collating conveyor.

Figure 2:
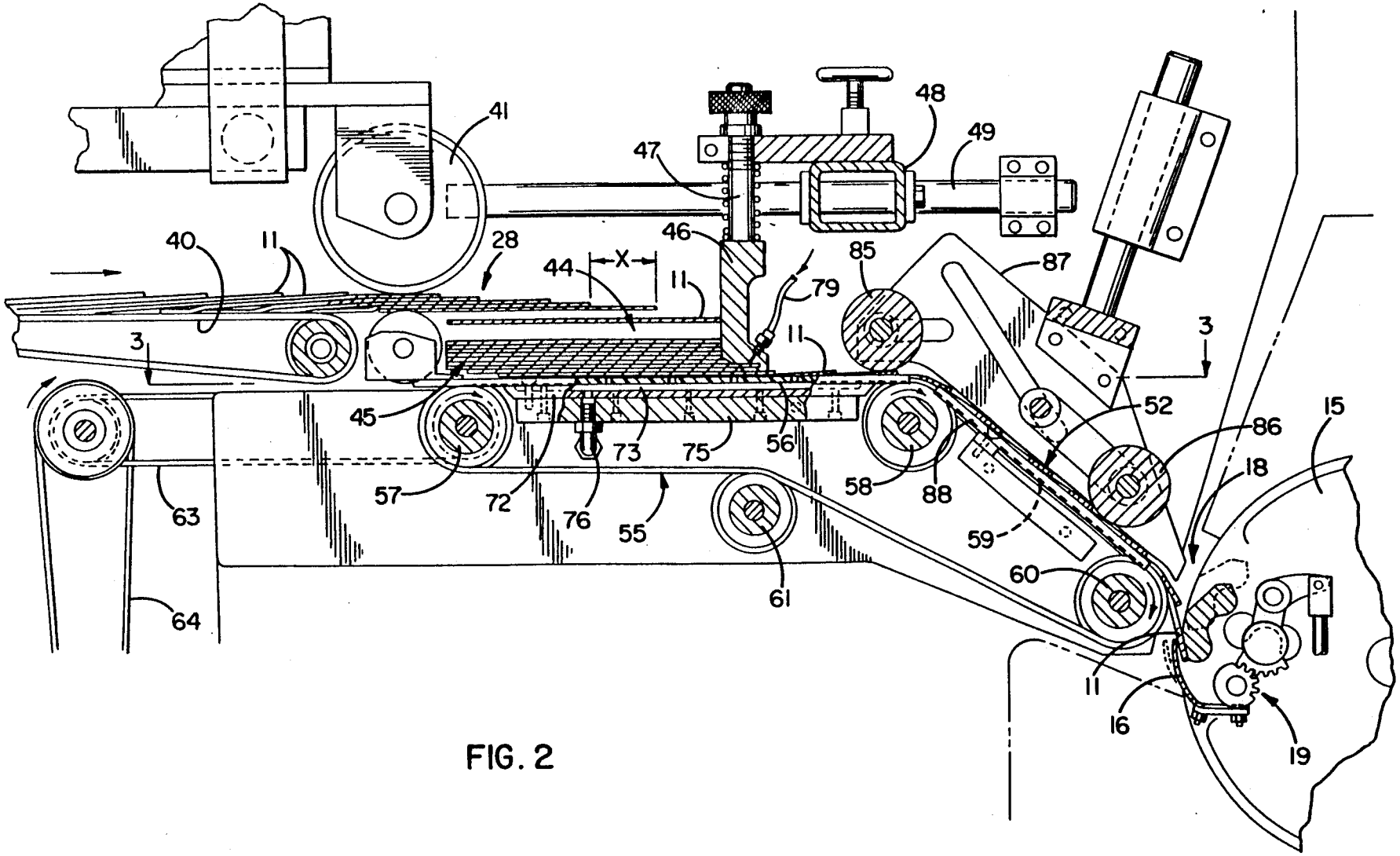
FIG. 2 is an enlarged view of certain components of the apparatus shown in FIG. 1.

The upstream portion of the apparatus 10 is generally similar to that of Newsome U.S. application Ser. No. 824,041, filed Jan. 23, 1992, now U.S. Pat. No. 5,222,720, issued Jun. 29, 1993. The apparatus includes a framework or base structure generally indicated by the reference numeral 23 and supported on wheels 24. Supported on the base 23 is a relatively large capacity product hopper 25 adapted to hold a stack 26 of signatures which are manually loaded into the hopper. The bottom of the hopper is defined by an upwardly inclined infeed conveyor 27 which strips the signatures one-by-one from the lower end of the stack 26 in the hopper and forms the signatures into a running shingle 28 (FIG. 2). As is well known, a shingle is a row of overlapping signatures which are arranged such that the trailing end portion of a leading signature underlies the leading end portion of the immediately trailing signature. The distance X between the leading edges of adjacent shingles is commonly called the shingle setback.

Driving of the infeed conveyor 27 is effected by a motor 29 (FIG. 1) which acts through a speed reducer 30 and a chain 31 to drive the input of an electrically controlled clutch 32, the output of the clutch being connected to the infeed conveyor by a chain 33. The infeed conveyor is driven whenever the clutch 32 is engaged and is stopped when the clutch is disengaged.

The shingle 28 on the infeed conveyor 27 is transferred to a second conveyor 34 which is inclined upwardly at a steeper angle than the infeed conveyor. A chain 35 leads from the output of the clutch 32 to the downstream end of the conveyor 34 in order to drive that conveyor whenever the infeed conveyor 27 is driven. Wheels 36 supported on pivoted arms 37 engage the side edges of the signatures 11 and maintain the lateral positioning of the signatures as they are carried upwardly by the conveyor 34.

The signatures 11 discharged from the upper end of the conveyor 34 are transferred to a third and generally horizontally extending conveyor 40. That conveyor is driven by the output of a clutch 41 whose input is driven by a chain 42 connected to the speed reducer 29. As the signatures advance to the downstream end of the conveyor 40, they pass beneath an accelerator wheel 41 which is rotated continuously at a constant speed. The wheel launches each signature forwardly into a hopper 44 so as to cause an upright stack 45 of generally horizontally disposed signatures to be formed in the hopper. As the signatures are propelled forwardly by the wheel 41, they strike two laterally spaced shoes 46 at the forward end of the hopper and drop downwardly into the hopper. The shoes are carried on the lower ends of spring-loaded rods 47 (FIG. 2) which are attached to a crossbar 48 supported by two cantilevered arms 49.

To detect the height of the stack 45, a photocell 50 (FIG. 1) is mounted on a fixed structure upstream of the hopper 44 and directs a light beam toward a reflector (not visible) at the forward end of the hopper. When the stack 45 is above a preselected level, the stack prevents the light beam from striking the reflector. As the stack falls below the reflector, reflection of the beam back to the photocell 50 causes the latter to produce an electrical signal. In this case, the signal is used to energize the clutches 32 and 41 and effect movement of the conveyors 27, 34 and 40 so as to cause additional signatures to be fed into the hopper 44. When the stack 45 rises to a level to block reflection of the beam, a timer is set by a signal from the photocell and, after a short delay, times out and effects de-energization of the clutches 32 and 41 so as to stop feeding of the signatures into the hopper 44. In this way, the signatures are fed into the hopper in very short bursts in order to keep the height, and thus the weight, of the stack relatively low (e.g., between one and four inches).

In order for the continuously driven accelerator wheel 41 to consistently launch signatures 11 one at a time into the hopper 44, it is not necessary for the setback X of the signatures in the shingle 28 to be precisely uniform from signature-to-signature. It is, however, necessary that the setback be relatively large (e.g., two inches) so that the wheel will only launch one signature at a time. If more than one signature is launched simultaneously, the trailing signature may collide with the leading signature and disrupt the integrity of the stack 45. The apparatus as described thus far is similar to that of the aforementioned Newsome application and is capable of establishing a shingle 28 of thin cross-section and with a relatively large setback.

In accordance with the primary aspect of the present invention, the signatures 11 in the stack 45 are stripped therefrom and are formed into a second running shingle 52 (FIG. 2) which is delivered to the drum 15. Successive leading signatures 11 in the shingle 52 are presented to successive grippers 16 rotating through the transfer station 18 and are pulled out of the shingle by the grippers themselves. By delivering the signatures to the grippers as a running shingle, the linear speed of the signatures during the delivery may be low compared to the surface speed of the drum 15 so as to obtain advantages to be explained subsequently.

Figure 3:
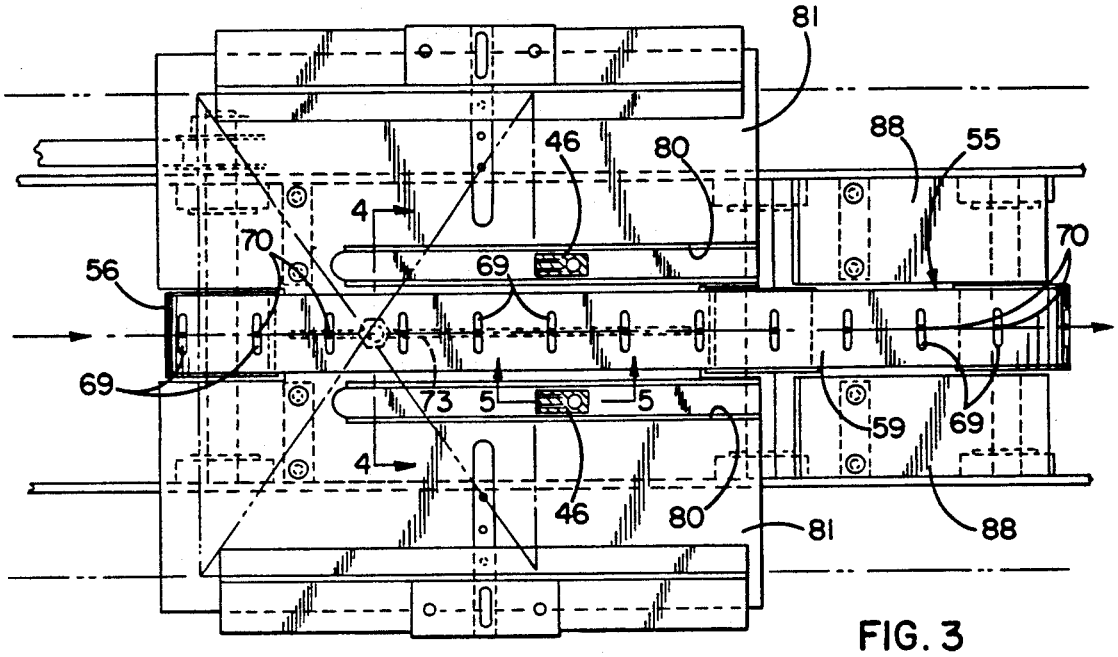
FIG. 3 is a cross-section taken substantially along the line 3—3 of FIG. 2.

Specifically, signatures 11 are stripped from the stack 45 by a conveyor 55 (FIG. 2) in the form of a flat rubber belt. The belt 55 has an upper run with a generally horizontal portion 56 established by guiding the belt around sheaves 57 and 58 whose axes are disposed in a common horizontal plane. In addition, the upper run of the belt 55 includes a downwardly inclined portion 59 (FIGS. 2 and 3) which slopes downwardly and forwardly from the downstream end of the horizontal portion 56. The downwardly sloped portion 59 of the upper run of the belt is established by guiding the belt around a sheave 60 (FIG. 2) spaced below and downstream of the sheave 58. After passing around the sheave 60, the belt is guided across a sheave 61 for return to the sheave 57. The latter sheave is adapted to be rotated by drive belts 63 and 64, the drive belt 64 being connected to an electronic drive unit 65 (FIG. 1) which receives its mechanical input via a chain 66 connected to a second speed reducer 67 associated with the motor 29. The drive unit 65 is electronically coupled to an encoder (not shown) associated with the drum 15 and serves to keep the belt 55 in time and in phase with the drum.

Figure 4:
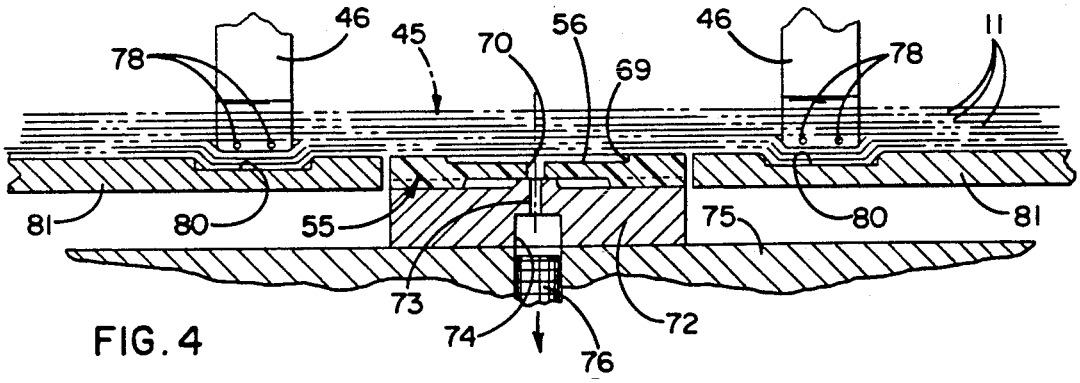
FIGS. 4 and 5 are enlarged fragmentary cross-sections taken substantially along the lines 4—4 and 5—5, respectively, of FIG. 3.

Vacuum is utilized to cause the belt 55 to strip signatures 11 from the lower end of the stack 45 and to form the signatures into the shingle 52. For this purpose, laterally elongated pockets 69 (FIGS. 3 and 4) are formed in and are spaced equally along the active face of the belt 55, each pocket communicating with a hole or passage 70 (FIG. 4) formed through the belt. The horizontal portion 56 of the upper run of the belt overlies and runs along the top of an elongated plate 72 which defines a vacuum plenum. A vertical slit 73 is formed in the upper surface of the plate along almost the entire length thereof and communicates with a chamber 74 formed in the plate and closed by a lower plate 75. A line 76 connected to the plate 72 communicates with the chamber 74 and leads to a vacuum pump (not shown). When the line 76 is subjected to vacuum, suction is created at the pockets 69 of the belt 55 via the chamber 74, the slit 73 and the passages 70. As the belt travels beneath the stack 45, the suction clutches the lowermost signature 11 in the stack to the belt so as to cause the signatures to be stripped from the stack and formed into the shingle 52.

Figure 5:
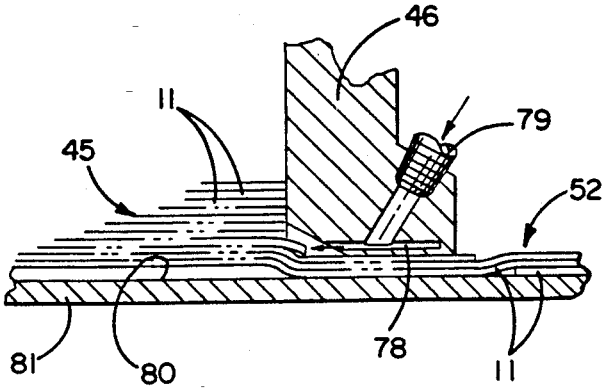

Pressurized air is used to lubricate the signatures 11 in the stack 45 and thus facilitate their release from one another. To this end, passages 78 (FIGS. 4 and 5) are formed through the lower end portion of each shoe 46 and communicate with a pressurized air source via a line 79. Air jets discharged from the passages 78 fluff the leading end portions of the lowermost signatures 11 to assist the belt 55 in consistently stripping only one signature at a time from the stack.

The lower end portions of the shoes 46 are located in elongated channels 80 (FIGS. 3 and 4) formed in opposite sides of the plates 81 disposed on opposite sides of the belt and adapted to support the signatures 11 as the latter are advanced by the belt. As each signature is advanced forwardly from the stack, the shoes press laterally spaced portions of the signature into the channels and iron shallow dimples into the signature.

The setback of the signatures 11 in the shingle 72 is substantially uniform from signature-to-signature and is equal to the spacing between adjacent pockets 69 in the belt 55 regardless of the speed of the belt. Typically, the setback of the shingle 72 ranges from 2½" to 4½", a shingle with a setback of 4½", having been shown. The setback may be changed by replacing the belt 55 with a belt having differently spaced pockets.

Signatures 11 stripped from the stack 45 pass beneath a nip roll 85 (FIG. 2) at the downstream end of the horizontal portion 56 of the belt 55. Thereafter, the signatures proceed downwardly and forwardly with the downwardly sloped portion 59 of the belt and pass beneath a second nip roller 86. The rollers 85 and 86 are supported by and are located between laterally spaced frame wings 87 which lightly press the signatures against downwardly inclined stationary plates 88 (FIG. 3) located on opposite sides of the sloped portion 59 of the belt 55.

Successive leading signatures 11 in the shingle 52, after passing beneath the nip roller 86, droop downwardly around the sheave 60 and enter the transfer station 18. At this time, the leading end portion of each leading signature enters into the gripper 16 arriving at the transfer station. Upon closing of the gripper, the signature 11 is pulled out of the shingle 52 and proceeds counterclockwise with the drum 15 for subsequent delivery to the collating conveyor 12.

Because the signatures 11 are delivered to the drum 15 as a shingle 52 rather than in spaced apart relation, the surface speed of the belt 55 may be significantly lower than the surface speed of the drum. If, for example, the setback of the shingle is 4½" and the two grippers 16 are spaced angularly from one another by 18", the surface speed of the belt need be only ¼ that of the drum in order to deliver a signature to each gripper. The relatively low speed of the belt reduces wear and tear on the belt and its drive and, in addition, allows for a greater margin of error in the setback of the shingle 72 while still enabling signatures to be placed in the grippers 16. In the example given, any error in the 4½" setback of the shingle is effectively reduced by 25 percent due to the low speed of the belt relative to the surface speed of the drum and thus the available window for feeding a signature into a gripper is increased.

I claim:

1. The combination of, a drum rotatable continuously about a generally horizontal axis and having a plurality of angularly spaced grippers each adapted to receive and close upon a signature as the gripper rotates through a transfer station, and an apparatus for feeding signatures to said grippers at said transfer station, said apparatus comprising an upright hopper, means for feeding a stream of signatures into the hopper for collection of the signatures in an upright stack in the hopper, conveyor means for stripping signatures one-by-one from the bottom of said stack and for advancing the signatures continuously and forwardly along a predetermined path as a running shingle having a substantially uniform setback, means for driving said conveyor means in timed relation with rotation of said drum, said conveyor means advancing said shingle toward said transfer station and presenting successive leading signatures in said shingle to successive grippers as the grippers rotate through said transfer station whereby successive leading signatures are pulled out of said shingle by successive grippers, said conveyor means comprising an endless belt having an upper run with a first portion extending generally horizontally beneath said hopper and with a second portion sloping downwardly and forwardly from said first portion and leading toward said transfer station, a series of holes space equally along and extending through said belt, and means located adjacent said hopper and beneath the first portion of the upper run of said belt for creating a vacuum, the vacuum acting through said holes to cause the first portion of the upper run of said belt to clutch successive lowermost signatures in said hopper and to strip such signatures from the bottom of said stack.

2. The combination defined in claim 1 further including plates located adjacent opposite edges of and in substantially the same plane as the second portion of the upper run of said belt and coacting with said belt to support said signatures as the latter are advanced to said transfer station, and means for pressing said signatures lightly against said belt and said plate as said signatures are advanced toward said transfer station.

3. The combination of, a drum rotatable continuously about a generally horizontal axis and having a plurality of angularly spaced grippers each adapted to receive and close upon a signature at a transfer station as the gripper rotates through said transfer station, and an apparatus for feeding signatures to said grippers at said transfer station, said apparatus being characterized by an upright hopper adapted to contain an upright stack of generally horizontally disposed signatures, conveyor means for stripping signatures one-by-one from the bottom of said stack and for continuously advancing said signatures fowardly first along a generally horizontal path and then along a downwardly and forwardly sloping path as a running shingle having a substantially uniform setback, means for driving said conveyor means in timed relation with rotation of said drum, the lower end of said downwardly sloping path being located at said transfer station, said conveyor means presenting successive leading signatures to successive grippers as said grippers rotate to said transfer station and while said signatures are still in said running shingle whereby successive leading signatures are pulled out of said shingle by successive grippers as the latter close upon the signatures and rotate out of the transfer station.

* * * * *